US006174319B1

(12) United States Patent
Desnos

(10) Patent No.: US 6,174,319 B1
(45) **Date of Patent: *Jan. 16, 2001**

(54) HAIR REMOVAL CONTAINERS AND DEVICES INCORPORATING A THERMOCHROMIC INDICATOR

(75) Inventor: Anne Desnos, Versailles (FR)

(73) Assignee: Reckitt Benckiser France, Massy Cedex (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/994,167

(22) Filed: Dec. 19, 1997

(30) Foreign Application Priority Data

Dec. 20, 1996 (EP) ..... 96402840
Mar. 24, 1997 (GB) ..... 9706107

(51) Int. Cl.[7] ..... A61B 17/50
(52) U.S. Cl. ..... 606/133; 606/134
(58) Field of Search ..... 606/133, 134; 424/73, 465; 374/141, 150; 401/2; 156/64; 128/736

(56) References Cited

U.S. PATENT DOCUMENTS

| | | | | |
|---|---|---|---|---|
| D. 281,822 | * | 12/1985 | Feldblum | D28/10 |
| 3,665,938 | | 5/1972 | Pedersen | 132/33 R |
| 3,858,985 | * | 1/1975 | Fiveash | 401/2 |
| 4,425,161 | * | 1/1984 | Shibahashi et al. | 106/21 |
| 4,450,023 | * | 5/1984 | De Blauwe | 156/64 |
| 4,717,710 | | 1/1988 | Shimizu et al. | 503/213 |
| 4,805,188 | * | 2/1989 | Parker | 374/141 |
| 4,832,949 | * | 5/1989 | Royal | 424/73 |
| 4,919,938 | * | 4/1990 | Fremin | 428/35.7 |
| 4,919,983 | | 4/1990 | Fremin | 428/35.7 |
| 4,957,949 | | 9/1990 | Kamada et al. | 523/201 |
| 5,158,765 | * | 10/1992 | Qasem | 424/465 |
| 5,720,555 | * | 2/1998 | Elele | 374/150 |

FOREIGN PATENT DOCUMENTS

| | | | |
|---|---|---|---|
| 0726041 A1 | 5/1996 | (EP) | A45D/26/00 |
| 0 726 041 A1 | 8/1996 | (EP) | A45D/26/00 |
| 0 752 221 A1 | 8/1997 | (EP) | A45D/26/00 |
| 2576495 | 1/1986 | (FR) | A45D/26/00 |
| 2113994 | 8/1993 | (GB) | A47L/13/32 |
| WO96/00021 | 1/1996 | (WO) | A45D/26/00 |

OTHER PUBLICATIONS

Patent Abstracts of Japan, vol. 010, No. 166 (C–353), Jun. 13, 1986 & JP 61 018714 A (Hariutsudo).
Copy of PCT International Search Report for PCT/GB97/03491 dated Apr. 6, 1998.

* cited by examiner

*Primary Examiner*—Michael Buiz
*Assistant Examiner*—Lien Ngo
(74) *Attorney, Agent, or Firm*—Fish & Richardson P.C.

(57) ABSTRACT

An epilatory wax container or a device, for example an applicator, for use in conjunction therewith includes a thermochromic material. The color change of the thermochromic material provides an indication that the wax in the container is at an appropriate temperature for application to the body.

20 Claims, No Drawings

HAIR REMOVAL CONTAINERS AND DEVICES INCORPORATING A THERMOCHROMIC INDICATOR

FIELD OF THE INVENTION

The present invention relates to the removal of unwanted hair from the body and, in particular, to the removal of unwanted hair from the human body by means of a wax composition.

BACKGROUND OF THE INVENTION

Various methods of hair removal are known. For example, the hair can be shaved from the body or can be removed by the use of tweezers or other instruments which pluck the hairs from the skin, such as devices including bent rotating coil springs and the like. In addition, chemical depilatory preparations and waxes have been formulated for the purpose of hair removal. Conventional depilatory preparations, often containing sulphide chemicals, act by weakening the structure of the hair to such an extent that scraping the cream off the skin breaks the hair at skin level and thus removes it. Alternatively, waxes can be applied to the skin which can then be peeled away with the hairs embedded therein.

Each of these methods has attendant disadvantages. Shaving brings only temporary alleviation since the roots of the hair are still present and the hair will grow again after a very short period. Also, there is the danger of cutting the skin on shaving. Chemical depilatory preparations tend to have an unpleasant smell and the use of waxes and coil spring devices can cause some discomfort.

Currently, waxes are increasing in popularity. Epilatory waxes tend to be supplied as generally solid materials which are melted prior to use. The molten material is applied to the skin, where at it cools and is then peeled away together with the unwanted hair. Often, a tool such as a spatula or stirrer is provided with the wax composition for applying the composition to the skin. Wax compositions may conveniently be heated in the container in which they are supplied, for example by means of a conventional or microwave oven or a hot water bath (a so-called "bain-marie"). However, a particular problem with such wax compositions lies in ensuring that the wax is heated to the correct temperature for application to the skin. If the wax is insufficiently hot, it may not be entirely molten and its effectiveness may be reduced. More seriously, if the wax is too hot, it may cause burns to the skin.

Therefore, it would be desirable to provide a means of ensuring that the wax is at the correct temperature before application to the skin.

Since the advent of thermochromic materials, indicator strips containing thermochromic materials have been applied to the outside of containers for temperature indication. For example, thermochromic liquid crystal inks have been used in labels placed on the outer surface of a container. However, the change in color of the ink of the label may not most accurately reflect the actual temperature of the contents of the container. For example, if the container is intended to be heated in a water bath, the label on the container would change as a consequence of the temperature of the water, and not the temperature of the contents of the container. Furthermore, thermochromic liquid crystal compositions change color at a precise temperature. Thus, an ink could be selected which would change color at a substantially precise temperature, for example at 50° C. or at 60° C.

However, such prior art systems are not ideal for use on a container of wax to indicate whether the wax is at a suitable temperature for application to the skin. This is because wax can be used safely and effectively over a reasonably broad temperature range, for example between about 44° C. and 58° C. Therefore, it would be preferable to be able to determine whether the temperature of the wax falls within a predetermined broad temperature range, rather than to be able to determine that the wax is at one specific temperature.

SUMMARY OF THE INVENTION

It has now been appreciated that, by ensuring a more intimate relationship between a thermochromic material and the wax, a more reliable indication of the temperature of the wax can be provided. In addition, in contrast to most prior art systems in which the change of color of the thermochromic material occurs over one to two degrees celsius, by way of the present invention it is possible to provide a visual indication that the temperature of the wax falls within a broad temperature range, within the whole of which temperature range the wax may be used safety. Thus, the danger of burning the skin is obviated.

According to a first aspect of the invention there is provided a container for an epilatory wax composition wherein the container includes a thermochromic material which is adapted to change color over a predetermined temperature range when in contact with a melting or molten epilatory wax composition.

According to a second aspect of the invention, there is provided an apparatus for the removal of hair from the body comprising a container of an epilatory wax composition, which wax is adapted to melt on heating, and an device for use in conjunction therewith, which device is adapted to make contact with a melting or molten wax composition, wherein the device includes a thermochromic material adapted to change color over a predetermined temperature range when in contact with the melting or molten wax composition.

In a particularly preferred embodiment of this aspect of the present invention, the said device is an applicator adapted to be used to apply the molten wax to the skin.

According to a third aspect of the invention there is provided a method of removing hair from the body, which method includes the steps of: providing a container of wax for epilation wherein the container itself has, or an apparatus comprising a container has a device which has, a thermochromic material which is adapted to change color over a predetermined temperature range when in contact with a melting or molten wax composition; heating the wax until the container and/or device reaches a desired temperature as indicated by a color change; applying the molten wax to the body; and removing the wax together with the unwanted hair.

DETAILED DISCLOSURE

As used in the present specification, the term "wax" refers generally to any composition used for the removal of hair from the body which is initially heated and is then applied to the body in a generally molten state, allowed substantially to solidify, and the removed from the body with the unwanted hair. Thus, the term includes both true waxes and other materials suitable for epilation, such as compositions based on resins or compositions based on sugars, in particular glucose.

The choice of material for the wax container or the device for use therewith is not especially limited, provided that the material is resistant to the temperatures employed on melting the wax. Also, the material of the container or device should be compatible with the chosen thermochromic material. In addition, if it desired that the thermochromic material be included in a device adapted to be used as a stirring or applicator means, the material of the device should have appropriate mechanical and chemical properties, that is, it should be sufficiently rigid to act as an effective stirrer or applicator. For example, the container for the epilatory wax may be comprised of wooden or a plastics material.

The temperature range within which the container or device changes color will be selected depending on the properties (in particular the melting point) of the particular wax used. However, the most important indication is that the wax is not too hot and will not therefore burn the skin. As waxes should not be applied to the skin at temperatures in excess of about 58° C., the container or device should therefore show a color change below that temperature.

The choice of thermochromic material used in the container for epilatory wax or the device for use therewith in accordance with the present invention is not particularly limited, although clearly the thermochromic material must change color within an appropriate temperature range. Wax can be used safely and effectively between about 44° C. and 58° C. Above about 58° C., the wax is too hot and may burn the skin. Below about 44° C., the wax becomes too viscous and is difficult to spread. Thus, the thermochromic materials used in accordance with the present invention will have a color change within a temperature range between about 40° C. and 62° C. A most preferred thermochromic material for use in accordance with the present invention changes color between 44° C. and 58° C., so that the intensity of the color of the thermochromic material begins to decrease at 44° C. and is at its minimum intensity at 58° C. Therefore, during the entire color change of the thermochromic material, the wax is at an appropriate temperature for application to the body. However, it will be appreciated that thermochromic materials that change color over other temperature ranges within the temperature range of about 40° C. and 62° C. are also appropriate. For example, a thermochromic material could be selected which changed color between 40° C. and 50° C. as, again, during the entire color change, the wax could be used safely. Also the thermochromic material must be compatible with the material of the container or device and should not leach from the container or device into the molten wax.

Suitable thermochromic materials may be found, for example, amongst those described in U.S. Pat. No. 4,717,710, pertinent portions of which are incorporated herein by way of reference. The thermochromic materials used in accordance with the present invention change color over a wide span of temperature, for example over a temperature range of about 5° to 20° C., and most preferably over a temperature range of about 8° to 15° C. For example, as noted above, a preferred thermochromic material for use in accordance with the present invention changes color between 44° C. and 58° C., that is over a temperature range of 14° C. However, many other thermochromic materials can be used in accordance with the present invention which change color over different temperature ranges, provided that they show a color change within a temperature range which is suitable for providing an indication that the wax in a container is at an appropriate temperature for application to the skin.

The first aspect of this invention relates to a container for the wax and the container itself includes a thermochromic material. According to a first embodiment of this aspect of the invention, the container for the wax includes a thermochromic material in its lid. Following the heating of the container and its inversion so that the molten wax is in direct contact with the lid, the lid of the container will then change color over a defined temperature range according to the temperature of the wax within the container. According to a second, less preferred, embodiment of this aspect, the thermochromic material is included in the walls of the container itself.

In a preferred embodiment of this aspect of the invention, one or more of the walls and/or lid of the wax container contain a thermochromic resin concentrate, which is adapted to change color within a temperature range between about 40° C. and 62° C., more preferably between 44° C. and 58° C. The resin concentrate is preferably present in an amount of from 5% to 15%, most preferably about 10%, of the overall polymer weight of the container. For example, the color of the wax bottle or jar and/or its lid may be red when the container is at low temperature, but the intensity of this color may begin to decrease at about 40° C. and the container may have lost its red color entirely at about 50° C. When the thermochromic material is incorporated into only the lid of a wax container, it will be necessary to invert the container after heating so that the molten wax is in contact with the part of the container which contains the thermochromic material. Then, according to the color of the lid of the container, the consumer will know whether or not the wax in the container is too hot for application to the skin.

In accordance with a preferred (second) aspect of the invention, the thermochromic material is included in a separate device adapted for use in conjunction with a container of epilatory wax.

In a preferred embodiment of this aspect of the invention, the said device comprises an applicator. The applicator may, for example, be a spatula made of wood. Alternatively, the applicator may comprise a spatula made of plastics material, especially polystyrene, polyethylene, polypropylene or polycarbonate. The spatula which includes the thermochromic material may then be dipped intermittently into the wax to see whether a change in color of the spatula is observed to thereby test the wax temperature. If the wax is at an appropriate temperature for application to the body, the molten wax can be applied to the skin using the spatula. Alternatively, the wax can be heated whilst stirring continuously with the spatula. If the color change of the spatula indicates that the wax is too hot for safe application to the skin, the wax is allowed to cool until the color of the spatula indicates that the wax has cooled to an appropriate temperature for use.

According to a further embodiment of the present invention, the epilatory wax can be used with a conventional spatula and the device for use in conjunction with the container of epilatory wax may comprise a further component, for example an independent stirring means or an indicator such as a plastic tester for dipping into the wax.

Alternatively, the device may be placed onto the molten wax in the container. For example, in a further embodiment of the invention, the device may comprise a strip of material, for example a piece of cardboard, which includes a thermochromic material such as an ink, and is thereby heat-sensitive and able to change color over a predetermined temperature range. The device can be placed intermittently on top of the wax or can be rested continuously on the wax as it is heated, until a color change is noted. Such a device could also be dipped into the wax after heating.

In another preferred variation of the invention, the device comprises a wooden spatula, on which is printed a printing ink which contains a thermochromic material. Thus, the spatula may initially have a graphic legend or a pictorial design printed thereon, for example. Assume, for example, that a particular wax is most preferably used between about 45° C. and 56° C., at which temperature it spreads correctly on the body and will not burn the skin. Therefore, a thermochromic material may suitably be incorporated into the printing ink on the spatula which starts to lose its color at about 44° C. and is completely colorless at about 58° C. Thus, the print on the spatula will start to disappear gradually in accordance with the temperature rise and will have disappeared completely at 58° C. due to the coating of the spatula with the wax composition. When the print has disappeared completely, there is a clear indication provided to the consumer that the wax may be too hot to be applied to the skin and should be allowed to cool slightly, that is, until the print reappears on the spatula. Whereas, if the consumer can see the print, the wax can be used safely.

The concept of using a printing ink which contains a thermochromic material is also applicable to the first aspect of the invention wherein the printing ink can be applied to the lid or sides of the container.

In a further variation of the invention, the device comprises a plastic spatula which incorporates a thermochromic resin concentrate. Preferably, the resin concentrate is present in an amount of from 5% to 15% of the overall polymer weight of the spatula. Most preferably, the resin concentrate is present in an amount of about 10% of the overall polymer weight. The spatula will exhibit one color at low temperature, but the intensity of this color will decrease in accordance with a temperature rise until the spatula becomes a different color at a predetermined temperature. For example, the spatula may contain a thermochromic resin concentrate which is initially blue, but which begins to lose its blue color at about 44° C. and becomes completely colorless at 58° C. In use, when the spatula reaches 58° C., the thermochromic material has lost its blue color entirely and the spatula becomes white. Thus, when the spatula becomes white, there is a clear indication provided to the consumer that the wax is too hot and must be allowed to cool slightly, that is, until the spatula regains some of its blue color. Also, the consumer will know that the wax is safe to use provided the spatula is blue, even if the blue color is of low intensity. The spatula will gradually lose its blue color over a temperature range between about 44° C. and 58° C., during all of which time the wax is at an appropriate temperature for application to the body.

Such a spatula is suitably made by injection moulding or by bi-injection moulding. If the spatula is made by bi-injection moulding, it is possible to incorporate the thermochromic material into one distinct area of the spatula. For example, the thermochromic material can be incorporated only into a small section (for example, 1 cm by 1 cm) of the spatula. In this case, only this panel will then undergo a distinct color change in accordance with the temperature of the wax, so as to provide the necessary indication that the wax is at an appropriate temperature for application to the body.

It is also known to provide a container for wax which consists of a bottle with an applicator provided at one end to enable the wax to be discharged from the container directly onto the skin of the user. In use, the bottle is subjected to elevated temperature and the container is then inverted so that the molten wax flows out of the container via the outlet of the applicator and onto the skin. According to a further embodiment of the second aspect of this invention, the thermochromic material is included in such an applicator.

Prior to the use of the wax, the container is inverted so that the wax can flow out of the container via the outlet of the applicator device. If the color change of the thermochromic material in the applicator indicates that the wax is too hot for application to the skin, the consumer will know that the wax should be allowed to cool slightly prior to use.

The container of epilatory wax is suitably made of glass or plastics material, preferably of plastics material. If the thermochromic material is to be incorporated into the lid of the container, the lid is suitably made by injection moulding or by bi-injection moulding. If the lid is made by bi-injection moulding, the thermochromic material can be incorporated into only portion of the lid, as discussed above.

Where the thermochromic material is incorporated into the container itself, the container is suitably made by extrusion or injection blow moulding. For example, the container can be made by mono-extrusion blow moulding (in which case the container will comprise only one plastics material) or by co-extrusion blow moulding (in which case the container will comprise different layers of plastics material). If the container is made by co-extrusion blow moulding, it is possible to incorporate the thermochromic pigment into only one of the layers of plastics material.

It will also be readily appreciated that the container or device may incorporate more than one thermochromic material, where desired. Thus, the container or device may change from a first color to a second color near the melting point of the wax and from the second color to a third color when the wax is too hot. For example, two thermochromic materials may be incorporated into the container of wax or the device for use therewith, so that one color is observed when the wax is not hot enough, a second color is observed when the wax is at the correct temperature for use and a third color is observed when the wax is too hot for use.

The epilatory wax compositions present in the containers according to this invention or associated with the devices according to this invention are used, in conventional manners, to remove unwanted hair from the human body. A container of a suitable wax, of the type discussed above, is provided and is heated by known means such as, for example, by placing the container in a microwave or conventional oven, a hot water bath, or in a specially designed heating unit which would be part of a kit comprising the subject container and, for example, a heating sleeve. When the wax in the container reaches the desired temperature—as indicated by the expected color change—the wax composition is ready for use. The wax is applied in its molten state to the areas of the body from which it is desired to remove hair. The wax readily solidifies and can then be removed, along with the unwanted hair.

This invention has been described in detail with particular reference to preferred embodiments thereof, but it will be understood that variations and modifications can be effected within the spirit and scope of the invention, which is defined in the following claims.

What is claimed is:

1. An apparatus in the form of a kit for the removal of hair from the human body comprising: a container which contains an epilatory wax composition to be heated by means external to said container, which melts on heating; and a spatula for use in conjunction therewith adapted to make contact with the melting or molten wax composition and to apply said composition to areas of the body where epilation is desired, wherein there is incorporated into the spatula a thermochromic material adapted to change color over a predetermined temperature range when said spatula is in contact with the melting or molten wax composition.

2. An apparatus according to claim 1 in which the spatula is comprised of wood or of a plastics material.

3. An apparatus according to claim 2 in which the spatula comprises wood on which is imprinted a legend or pictorial design using a printing ink which includes the thermochromic material, wherein the printing ink begins to lose its color at about 44° C. and, with increasing temperature, gradually loses further color until said ink becomes substantially invisible at about 58° C.

4. An apparatus according to claim 2 in which the spatula is made of a polymeric plastic which incorporates, in an amount of from 5% to 15%, the thermochromic material in the form of a resin concentrate, wherein the spatula exhibits one color at a temperature below about 44° C. and, as the temperature rises above 44° C., begins to gradually lose further color until all of said color is lost at a temperature of about 58° C., at which point only the underlying color of the spatula remains visible.

5. An apparatus according to claim 2 in which the thermochromic material is incorporated only into a portion of the spatula.

6. An apparatus according to claim 1 wherein the epilatory wax comprises a sugar-based composition.

7. An apparatus according to claim 1 in which the thermochromic material in the spatula changes color over a temperature range of between 5° C. and 20° C.

8. An apparatus according to claim 7 in which the thermochromic material in the spatula changes color over a temperature range of between 8° C. and 15° C.

9. An apparatus according to claim 1 in which the thermochromic material in the spatula changes color between 44° C. and 62° C.

10. An apparatus according to claim 9 in which the thermochromic material in the spatula changes color between 44° C. and 58° C.

11. A method of removing hair from the human body which method comprises the steps of:

providing an apparatus comprising a container which contains an epilatory wax which melts on heating and a separate spatula into which is incorporated a thermoplastics material adapted to change color over a predetermined temperature range when in contact with the melting or molten wax composition;

heating the wax by means external to the container until the container and spatula reach a desired temperature as indicated by a color change;

applying the molten wax from the spatula to areas of the body where epilation is desired; and removing the wax together with unwanted hair.

12. A method according to claim 11 in which, in the apparatus, the thermochromic material in the spatula changes color over a temperature range of between 8° C. and 15° C.

13. A method according to claim 11 in which, in the apparatus, the thermochromic material in the spatula changes color between 44° C. and 62° C.

14. A method according to claim 13 in which, in the apparatus, the thermochromic material in the spatula changes color between 44° C. and 58° C.

15. A method according to claim 11 in which, in the apparatus, the spatula is comprised of wood or of a plastics material.

16. A method according to claim 15 in which, in the apparatus, the spatula is comprised of wood and a legend is imprinted thereon.

17. A method according to claim 11 in which, in the apparatus, the spatula comprises wood on which is imprinted a legend or pictorial design using a printing ink which includes the thermochromic material, wherein the printing ink begins to lose its color at about 44° C. and, within increasing temperature, gradually loses further color until said ink becomes substantially invisible at about 58° C.

18. A method according to claim 11 in which, in the apparatus, the spatula is made of a polymeric plastic which incorporates, in an amount of from 5% to 15%, the thermochromic material in the form of a resin concentrate, wherein the spatula exhibits one color at a temperature below about 44° C. and, as the temperature rises above 44° C., begins to gradually lose further color until all of said color is lost at a temperature of about 58° C. at which point only the underlying color of the spatula remains visible.

19. A method according to claim 11 in which, in the apparatus, the thermochromic material is incorporated to only a portion of the spatula.

20. A method according to claim 11 in which, in the apparatus, the depilatory wax comprises a sugar-based composition.

* * * * *